US006428152B1

(12) United States Patent
Hollands

(10) Patent No.: US 6,428,152 B1
(45) Date of Patent: Aug. 6, 2002

(54) CONSTANT PRESSURE INK RESERVOIR FOR AN INK JET PRINTER

(75) Inventor: Peter Joseph Hollands, Baarlo (NL)

(73) Assignee: Oce Technologies B.V., Venlo (NL)

( * ) Notice: Subject to any disclaimer, the term of this patent is extended or adjusted under 35 U.S.C. 154(b) by 0 days.

(21) Appl. No.: 09/361,187

(22) Filed: Jul. 27, 1999

(30) Foreign Application Priority Data

Mar. 9, 1998 (EP) ..... 98202928

(51) Int. Cl.[7] ..... B41J 2/175
(52) U.S. Cl. ..... 347/85
(58) Field of Search ..... 347/85, 86, 87, 347/92

(56) References Cited

U.S. PATENT DOCUMENTS

| | | | | |
|---|---|---|---|---|
| 4,339,761 A | | 7/1982 | Matsumoto et al. | 347/85 |
| 4,509,062 A | | 4/1985 | Low et al. | 347/87 |
| 5,039,999 A | | 8/1991 | Winslow et al. | 347/87 |
| 5,504,511 A | * | 4/1996 | Nakajima et al. | 347/86 |
| 5,650,811 A | | 7/1997 | Seccombe et al. | 347/85 |
| 5,737,001 A | | 4/1998 | Taylor | 347/85 |

FOREIGN PATENT DOCUMENTS

| | | |
|---|---|---|
| EP | A1 0375383 | 6/1990 |
| GB | A 2265860 | 10/1993 |
| JP | A 54067433 | 7/1979 |
| JP | A 01145154 | 9/1989 |

* cited by examiner

*Primary Examiner*—Michael Nghiem
(74) *Attorney, Agent, or Firm*—Birch, Stewart, Kolasch & Birch, LLP

(57) ABSTRACT

An apparatus for controlling the pressure in an ink reservoir of an ink jet printer, including a casing and a piston movable relative to the casing and defining therewith a variable-volume chamber communicating with the ink reservoir, the piston being biased to maintain a pressure difference between the variable-volume chamber and the outside, wherein the piston is biased mainly by gravitational forces.

14 Claims, 2 Drawing Sheets

CONSTANT PRESSURE INK RESERVOIR FOR AN INK JET PRINTER

BACKGROUND OF THE INVENTION

The present invention relates to an apparatus for controlling the pressure in an ink reservoir of an ink jet printer, comprising a casing and a piston movable relative to the casing and defining therewith a variable-volume chamber communicating with the ink reservoir, the piston being biased to maintain a pressure difference between the variable-volume chamber and the outside.

An ink jet printer typically comprises printhead having one or more nozzle arrays and an ink reservoir from which liquid ink is supplied to the nozzles of the nozzle arrays, so that ink droplets may be ejected from the nozzles by thermal or piezoelectric action, as is generally known in the art. When the level of ink in the ink reservoir is higher than the level of the nozzles, the ink reservoir should be maintained at subatmospheric pressure in order to avoid ink from leaking out through the nozzles. Since the difference between the internal pressure in the ink reservoir and the atmospheric pressure has an influence on the process of droplet generation and hence on the quality of the printed image, it is desirable to keep this pressure difference constant. Since, however, the internal pressure in the ink reservoir may vary in response to changes in the ink volume contained therein, thermal expansion and the like, it is necessary to control the internal pressure in the ink reservoir.

U.S. Pat. No. 5,039,999 discloses a pressure control apparatus of type indicated above, in which a coil spring is employed for biasing the piston. U.S. Pat. No. 4,509,062 discloses another type of pressure control apparatus in which the variable-volume chamber is bounded by an elastically deformable bladder.

Both conventional designs have the drawback that the elastic biasing forces which maintain the pressure difference between the internal pressure in the ink reservoir and the atmosphere depend on the amount of deformation of the spring or the bladder, respectively, so that the pressure difference may still vary along with the expansion or contraction of the variable-volume chamber.

EP-A-0 375 383 describes a pressure control apparatus in which the variable-volume chamber is partly bounded by a rolling diaphragm. This rolling diaphragm provides a substantially linear volume/pressure characteristic, similar to that of a piston biased by a coil spring. In this apparatus, the rolling diaphragm is used only for mitigating the pressure fluctuations in response to volume changes, and the pressure is ultimately maintained constant by sucking air bubbles or liquid into the variable-volume chamber through a small orifice. Thus, this apparatus requires a rather complicated design and further has the problem that slight pressure fluctuations are induced by the air bubbles sucked into the variable-volume chamber.

SUMMARY OF THE INVENTION

It is an object of the present invention to provide a simple apparatus which maintains the internal pressure in the ink reservoir at a constant value with high accuracy.

According to the present invention, this object is achieved with an apparatus in which the piston is biased mainly by gravitational forces.

Since the gravitational forces which may be created by the weight of the piston itself or by an additional load applied thereto are constant irrespective of any changes in the volume of the variable-volume chamber, the internal pressure in the ink reservoir, or more exactly, the pressure difference between the ink reservoir and the outside, can be maintained constant with high accuracy even when the volume of the variable-volume chamber is allowed to vary within a comparatively large range. As a result, a high quality of the printed image can be achieved even with a system in which the droplet generation process is highly sensitive to the pressure drop across the nozzles, and the ingress of air into the nozzles is safely prevented. The apparatus according to the present invention is particularly useful in combination with a hot-melt ink jet printhead which is operated at elevated temperatures.

Preferably, the piston is connected to the walls of the casing defining the variable-volume chamber by means of a highly flexible diaphragm which provides a perfect seal for the gap between the piston and the walls of the casing without inducing any substantial friction between the piston and the casing. As a result, the frictional effects are negligible, even in the case where the internal pressure in the ink reservoir is only slightly below atmospheric pressure, e.g. in the order of 1 kPa below atmospheric pressure, and the effective pressure-sensitive area of the piston is comparatively small, wherein the gravitational forces involved in biasing the same are extremely small.

In a particularly preferred embodiment, the casing defining the variable-volume chamber has the form of a cylinder, and the piston is fitted therein with a small annular gap formed between the outer circumferential surface of the piston and the inner circumferential surface of the cylinder walls, and the rolling diaphragm is accommodated in this annular gap. In this way, a particularly compact construction of the apparatus is achieved, and the diaphragm is smoothly and stably guided in the cylinder without any substantial friction. Since the diaphragm is not subject to any substantial tensile stresses, it can be made extremely thin so that to will not exert any elastic forces on the piston. The pressure difference between the inside and the outside of the variable-volume chamber will help to keep the two layers of the rolling diaphragm apart, and since, when the piston is displaced, relative movement occurs only between the two layers of the diaphragm, friction is almost completely eliminated. In addition, since the diaphragm is not required to have elastic properties, the material may be optimized in view of reducing its frictional coefficient relative to itself.

While the printhead of an ink jet printer is generally mounted on a moving carriage, the pressure control apparatus can be mounted on a stationary frame of the printer and can be connected to the ink reservoir of the printhead through a flexible hose. Thus, the weight-biased piston will not be subject to any substantial forces of inertia. If the printhead comprises a plurality of ink reservoirs, for example in a color printer, all ink reservoirs may be connected to same pressure control apparatus.

Due to the constant gravitational forces acting upon the piston, the displacement of the piston depends linearly on the total air volume in the ink reservoir, the variable-volume chamber and the hose connection therebetween. In the long run, this air volume tends to slightly increase due to leakage or diffusion. In a preferred embodiment, this increase of the air volume is detected by monitoring the position of the piston, so that a reset process for evacuating the ink reservoir can be initiated automatically, when necessary. Likewise, the displacement of the piston can be used for generating a signal for automatically terminating the evacuation process when the air volume has again reached its target value. As an alternative, the variable-volume chamber is reset to a specific volume at regular intervals, for example at the end of each scan cycle of the printer.

BRIEF DESCRIPTION OF THE DRAWINGS

The preferred embodiments of the present invention will now be described in conjunction with the accompanying drawings, wherein.

DETAILED DESCRIPTION OF THE INVENTION

Figure 1:
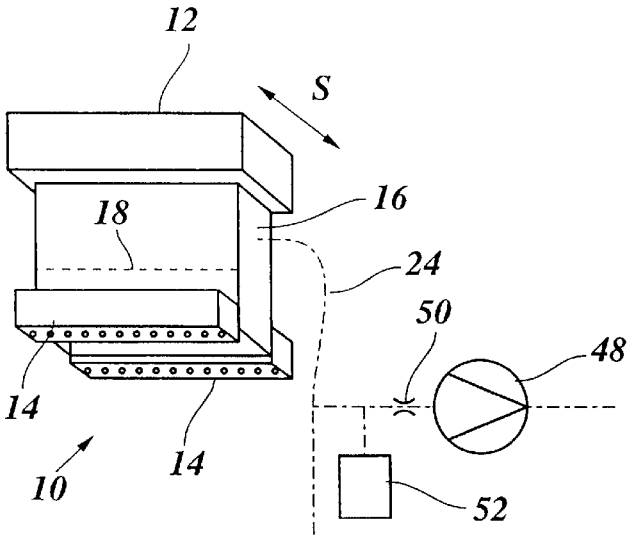
FIG. 1 is a sectional view of the main components of a pressure control apparatus, with associated, components of an ink jet printer, depicted schematically.

As is shown in FIG. 1, a printhead 10 of an ink jet printer is mounted on a carriage 12 that performs scan movements in a direction indicated by the double-arrow S. The printhead comprises two nozzle arrays 14 attached to the lower edge of an ink reservoir 16. When the printer is operative, the ink can be supplied to the nozzles of the nozzle arrays 14. The level of the liquid ink in the ink reservoir 16 is indicated by a dashed line 18. Since this ink level is higher than the level of the nozzles in the nozzle arrays 14, the ink in the nozzles is under a static pressure, so that ink might tend to leak out of the nozzles. For this reason, the air volume above the ink level 18 in the ink reservoir 16 is maintained at a slightly subatmospheric pressure, e.g. 1 kPa below atmospheric pressure.

This pressure is controlled by means of a pressure control apparatus 20 that is mounted to a stationary frame 22 of the printer and is connected to the top part of the ink reservoir 16 by a flexible hose 24.

The pressure control apparatus 20 comprises a casing 26 shaped as an upright cylinder and having an open bottom. A port 28 to which the hose 24 is connected is formed in the top wall of the casing 26.

A cylindrical cup-shaped piston 30 is slidably disposed in the casing 26 with the open end facing upward into the interior of the casing, so that a variable-volume chamber 32 is defined inside of the casing 26 and the piston 30.

A rolling diaphragm 34 in the form of a hose or bag made of extremely thin flexible material has an end portion 36 sealingly connected to the lower edge of the circumferential wall of the casing 26, and the other end of the diaphragm is sealingly connected to the bottom of the piston 30.

The outer circumferential surface of the piston 30 and the internal wall of the casing 26 define an annular gap 40, which accommodates the main part of the diaphragm 34. This main part forms an outer layer 42 engaging the wall of the casing 26 and an inner layer 44 engaging the outer circumferential surface of the piston 30. The outer and inner layers 42, 44 are interconnected at their top ends by a rolling rim 46.

The piston 30 is biased downwardly by its own weight and thus tends to expand the variable-volume chamber 32. Since the diaphragm 34 forms an air-tight seal between the piston and the casing 26, the expansion of the variable-volume chamber 32 causes the pressure prevailing in this chamber and also in the ink reservoir 16 to drop below atmospheric pressure. The piston 30 therefore assumes an equilibrium position in which the gravitational forces are counterbalanced by the differential pressure acting on the bottom face of the piston. Thus the internal pressure in the ink reservoir 16 is maintained at a constant value which is determined by the weight and the cross-sectional area of the piston 30.

It is important to note that the diaphragm 34 does not exert any elastic forces on the piston 30, regardless of the displacement of the latter. Although minor elastic stresses may occur in the rolling rim 46 of the diaphragm, these forces do not bias the piston upwardly or downwardly but rather tend to center the piston on the axis of the casing 26.

Due to the subatmospheric pressure in the variable-volume chamber 32, ambient air will penetrate into the small gap between the outer and inner layers of the diaphragm 34 and will hold these layers in engagement with the walls of the casing 26 and the piston 30, respectively. Thus, the outer and inner layers 42, 44 will always be separated by a slight gap so that no frictional forces between these layers will impede the axial displacement of the piston 30.

When the ink level 18 in the ink reservoir 16 changes or the air above this ink level undergoes thermal expansion, the piston 30 is free to move in the casing 26, so that the pressure in the ink reservoir will always be maintained constant.

Figure 2:
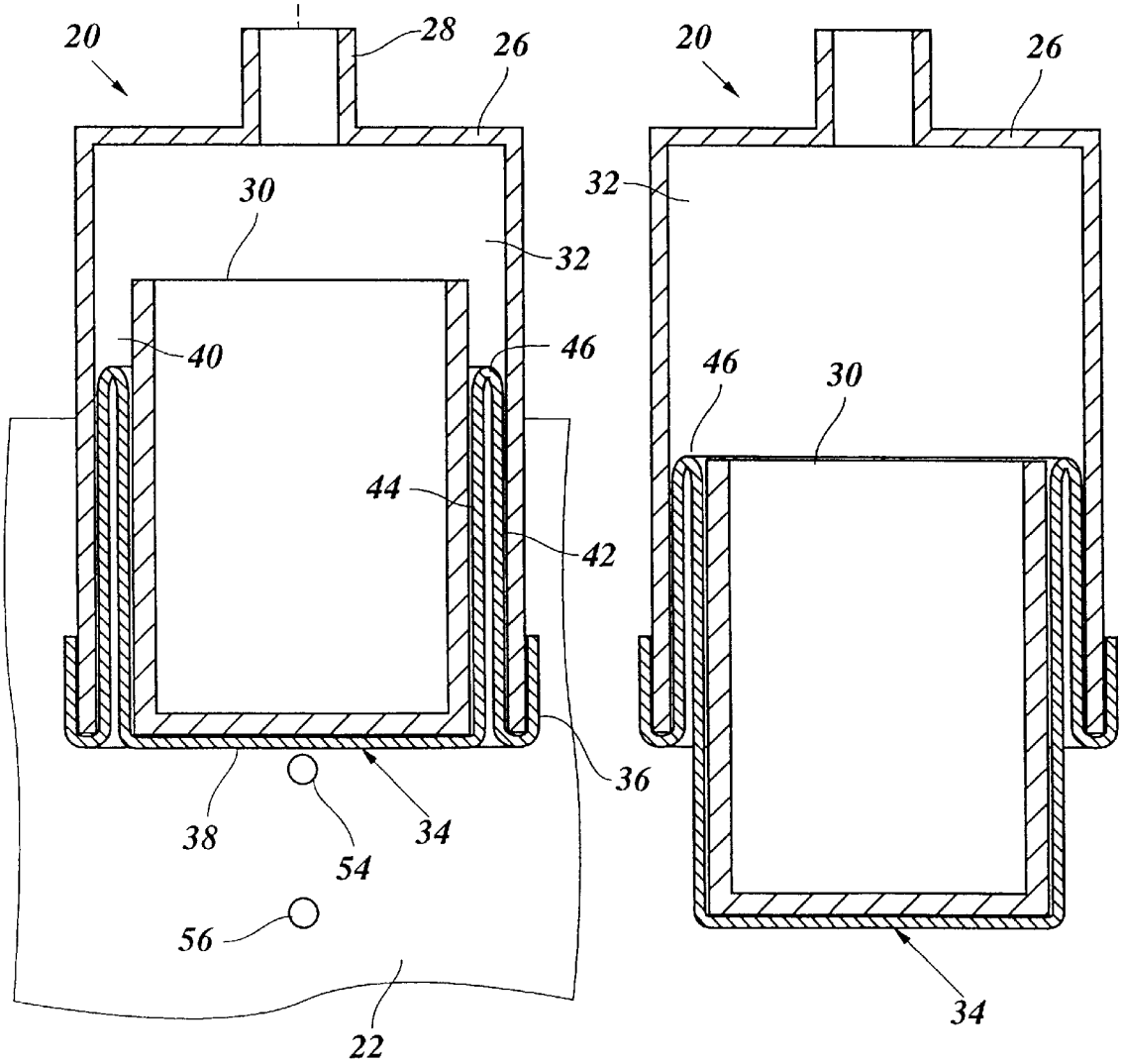
FIG. 2 is a sectional view of the apparatus shown in FIG. 1 in a different operating state.

In the long run, the subatmospheric pressure prevailing in the ink reservoir and the variable-volume chamber 32 may cause an ingress of air due to leakage, diffusion or the like. As a result, the piston 30 will gradually move downward, as is illustrated in FIG. 2. This gradual downward movement of the piston should be compensated from time to time by "resetting" the piston. To this end, a vacuum pump 48 is connected to the hose 24 as is shown in FIG. 1. When the vacuum pump 48 is operated, the ink reservoir 16 and the variable-volume chamber 32 are evacuated, so that the piston 30 will rise again. An orifice 50 limits the flow of air drawn out of the ink reservoir and the variable-volume chamber, so that the piston 30 can readily keep-up with the evacuation of air, without causing a temporary pressure drop in the ink reservoir. A pressure accumulator 52 connected between the orifice 50 and the hose 24 smoothes out the pressure fluctuations that might be caused by the vacuum pump 48.

In the embodiment shown in FIG. 1, a position sensor 54, e.g. an optical sensor, is mounted to the frame 22. When the variable-volume chamber 32 is evacuated and the piston 30 rises to the position shown in FIG. 1, the sensor 54 will deliver a signal for switching off the vacuum pump 48. Thus, the original position of the piston 30 can be restored automatically after an evacuation has been initiated.

Optionally, another position sensor 56 is provided in a lower position than the sensor 54. When the piston 30 has been lowered to the position shown in FIG. 2, due to the ingress of air, the sensor 56 will deliver a signal for automatically initiating an evacuation process.

Figure 3:
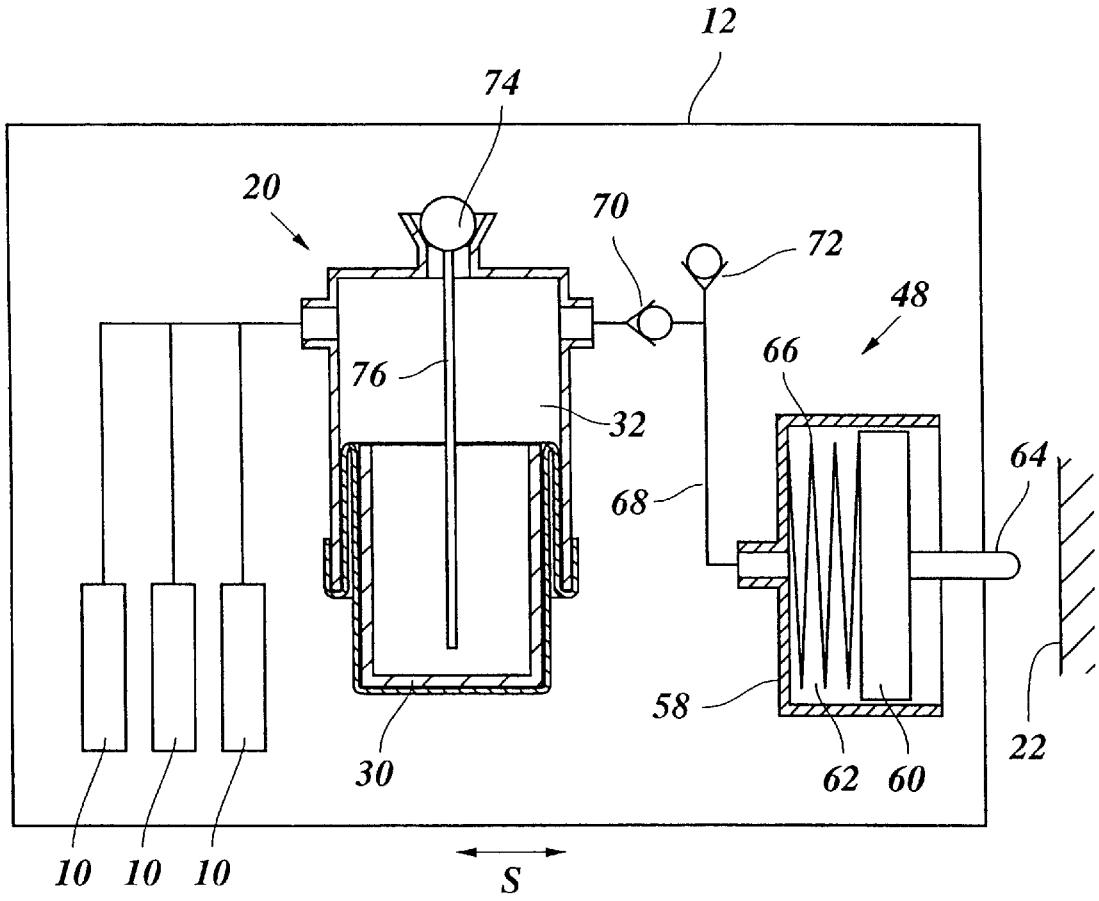
FIG. 3 is a diagram of a reset mechanism for the pressure control apparatus in a printer according to a modified embodiment of the present invention.

FIG. 3 illustrates a modified embodiment of a reset mechanism for resetting the pressure control apparatus 20 in regular time intervals. In this embodiment, the pressure control apparatus 20 and a plurality of printheads 10 of, for example, a color printer, are commonly mounted on the carriage 12 which moves back and forth relative to the frame 22 of the printer. The vacuum pump 48 is also mounted on the carriage 12. Thus, the pressure control apparatus 20 can be connected to the printheads 10 and the vacuum pump 48 by rigid pipings, so that no flexible hoses are required.

The vacuum pump 48 comprises a cylinder 58 and a piston 60 which define a working chamber 62. The piston 60 is movable relative to the cylinder 58 in a direction parallel with the scan direction S of the carriage 12 and comprises a plunger 64 which projects towards a portion of the frame 22. A compression spring 66 accommodated in the working chamber 62 biases the piston 60 towards said portion of the frame, i.e. in a direction which increases the volume of the working chamber.

A vacuum line 68 connects the working chamber 62 of the vacuum pump to the variable volume chamber 32 of the pressure control apparatus 20 and includes a first check valve 70 which opens in the direction of the vacuum pump 48. Another check valve 72 opens to the atmosphere and is connected to the vacuum line 68 between the first check valve 70 and the vacuum pump.

A third check valve 74 which also opens to the atmosphere is arranged in the top wall of the casing of the pressure control apparatus 20. The valve member of this check valve is connected to an control rod 76 which projects downwardly into the piston of the pressure control apparatus.

When the printer is operating and the carriage 12 reaches an end position of its scan stroke, the plunger 64 abuts against the frame 22, and the piston 60 is pressed inwardly against the force of the compression spring 66. The air displaced out of the working chamber 62 is vented through the check valve 72 while the check valve 70 is closed. When the carriage 12 then performs the next scan cycle and moves away from the frame 22, the working chamber 62 is expanded again by the force of the compression spring 66. Under these conditions, the check valve 72 closes and the check valve 70 opens so that air is sucked out of the variable-volume chamber 32 and into the working chamber 62. As a result, the piston 30 of the pressure control apparatus is caused to rise.

When the rising piston 30 reaches a certain zero-position, the bottom of the piston abuts against the end of the control rod 76 and causes the check valve 74 to open. Thus, while the compression spring 66 continues to expand, the air sucked out of the variable-volume chamber 32 is replaced by ambient air drawn-in through the open check valve 74. As a result, the piston 30 will not rise further but will stay in the zero-position. When the compression spring 66 approaches its equilibrium position, i.e. when its biasing force approaches zero, the suction force of the vacuum pump 48 can no longer overcome the suction force caused by the weight of the piston 30. At this instant, the check valves 70 and 74 close, and the variable-volume chamber 32 is disconnected from both the ambient air and the vacuum pump 48, so that the vacuum pressure in the variable-volume chamber 32 is again determined only by the weight of the piston 30 which has been restored to its zero-position. Thus, the reset process is completed.

The reset process described above is repeated after each scan cycle of the carriage 12, each time the plunger 64 engages the frame 22.

While specific embodiments of the present invention have been described above, it will occur to a person skilled in the art that various modifications can be made without departing from the scope of the present invention.

What is claimed is:

1. An apparatus for controlling the pressure in an ink reservoir of an ink jet printer which comprises a casing and a piston movable relative to the casing and defining therewith a variable-volume chamber for communication with a volume of air in the ink reservoir, said piston being biased to maintain a pressure difference between the variable-volume chamber and the outside, said biasing being primarily effected by gravitational forces, said forces being constant irrespective of any changes in the volume of the variable-volume chamber.

2. The apparatus according to claim 1, wherein the piston is sealingly connected to walls of the casing by a flexible diaphragm, which is arranged to exert no substantial elastic forces on the piston in the direction of displacement of the piston.

3. The apparatus according to claim 2, wherein the diaphragm is a rolling diaphragm.

4. The apparatus according to claim 3, wherein the casing is cylindrical and the piston is also cylindrical and is guided in the casing by the walls thereof with a small annular gap formed between the outer circumferential surface of the piston and the inner circumferential surface of the walls of the casing, said gap accommodating outer and inner layers of the rolling diaphragm.

5. The apparatus of claim 1, wherein the piston is biased by its own weight.

6. The apparatus of claim 1, wherein a vacuum pump is provided for withdrawing air from the variable-volume chamber.

7. The apparatus according to claim 6, wherein a position sensor is provided for detecting the position of the piston and delivering a signal for switching off the vacuum pump when the piston reaches a predetermined position.

8. The apparatus according to claim 7, wherein another position sensor is provided for detecting the position of the piston and delivering a signal for switching on the vacuum pump when the piston reaches another predetermined position.

9. The apparatus according to claim 6, wherein the variable-volume chamber is connectable to the atmosphere by a controllable check valve, and control means are arranged to open the check valve when the piston rises to a predetermined position.

10. An ink jet printer comprising a movable printhead with an ink reservoir for containing liquid ink and an air volume disposed above the level of the ink, and a pressure control device connected to the air volume above the level of ink, said pressure control device comprising a casing, and a piston movable relative to the casing and defining therewith a variable-volume chamber for communication with the ink reservoir, said piston being biased to maintain a pressure difference between the variable-volume chamber and the outside, said biasing being primarily effected by gravitational forces.

11. The ink jet printer according to claim 10, wherein the pressure control device is mounted on a stationary frame of the printer and is connected to the moving printhead by a flexible hose.

12. The ink jet printer according to claim 10, wherein the pressure control device is mounted on a moving carriage of the printer, and a vacuum pump is connected to the carriage for withdrawing air from the variable-volume chamber and is driven by the relative movement of the carriage and the frame of the printer.

13. The ink jet printer according to claim 12, wherein the vacuum pump is mounted on the carriage and includes a plunger which engages a portion of the frame of the printer when the carriage approaches an end position at the end of each scan cycle.

14. The inkjet printer according to claim 13, wherein the vacuum pump comprises a cylinder, a piston defining a work chamber in said cylinder, a spring for biasing the piston of the vacuum pump in the direction of increasing volume of the work chamber, and a check valve assembly connecting the work chamber to the atmosphere when the volume of the work chamber is reduced by the plunger engaging the frame, and the work chamber being connected to the variable-volume chamber when the volume of the work chamber is increased by the action of the spring.

* * * * *